US008559848B2

(12) United States Patent
Moon et al.

(10) Patent No.: US 8,559,848 B2
(45) Date of Patent: Oct. 15, 2013

(54) CHARGING MEMBER ASSEMBLY USABLE WITH BODY TO BE CHARGED AND CHARGING APPARATUS FOR IMAGE FORMING APPARATUS

(75) Inventors: Ji-Won Moon, Anyang-Si (KR); Mi-Na You, Seoul (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 643 days.

(21) Appl. No.: 12/508,135

(22) Filed: Jul. 23, 2009

(65) Prior Publication Data

US 2010/0104320 A1 Apr. 29, 2010

(30) Foreign Application Priority Data

Oct. 29, 2008 (KR) ..... 10-2008-0106668

(51) Int. Cl.
*G03G 21/18* (2006.01)

(52) U.S. Cl.
USPC ..... 399/115; 399/123; 399/176; 399/350; 399/351

(58) Field of Classification Search
USPC ..... 399/115, 123, 351
See application file for complete search history.

(56) References Cited

U.S. PATENT DOCUMENTS

| | | | | |
|---|---|---|---|---|
| 6,522,851 | B2 * | 2/2003 | Stickler | 399/176 |
| 6,741,829 | B2 * | 5/2004 | Stickler et al. | 399/351 |
| 7,529,498 | B2 * | 5/2009 | Kitagawa et al. | 399/100 |
| 7,603,052 | B2 * | 10/2009 | Honobe et al. | 399/100 |
| 7,616,913 | B2 * | 11/2009 | Matsui et al. | 399/100 |
| 8,301,058 | B2 * | 10/2012 | Kim | 399/115 |
| 8,380,106 | B2 * | 2/2013 | Gayne et al. | 399/117 |
| 2003/0086725 | A1 * | 5/2003 | Palumbo et al. | 399/176 |
| 2005/0141916 | A1 * | 6/2005 | Arimitsu et al. | 399/111 |
| 2005/0191081 | A1 * | 9/2005 | Muraishi et al. | 399/100 |
| 2007/0041761 | A1 * | 2/2007 | Kim | 399/351 |
| 2007/0189801 | A1 * | 8/2007 | Miyaji et al. | 399/100 |
| 2007/0269234 | A1 * | 11/2007 | Kurita et al. | 399/111 |
| 2008/0181659 | A1 * | 7/2008 | Noh | 399/114 |
| 2011/0243600 | A1 * | 10/2011 | Gonzales Perez et al. | 399/109 |
| 2012/0195664 | A1 * | 8/2012 | Kuwabara et al. | 399/357 |
| 2013/0129385 | A1 * | 5/2013 | Kim et al. | 399/115 |
| 2013/0129389 | A1 * | 5/2013 | Moon et al. | 399/258 |

FOREIGN PATENT DOCUMENTS

JP 2005156655 A * 6/2005

OTHER PUBLICATIONS

English machine translation of Japanese patent document Shintani et al. (JP2005156655A); original document published Jul. 16, 2005; by Shintani, Susumu; Maejima, Hideki; and Tsuzuki, Masamoto.*

* cited by examiner

*Primary Examiner* — David Gray
*Assistant Examiner* — Geoffrey Evans
(74) *Attorney, Agent, or Firm* — Stanzione & Kim, LLP

(57) ABSTRACT

Disclosed is a charging apparatus usable with an image forming apparatus that includes a body to be charged; a housing to rotatably support the body to be charged, a charging member to charge a surface of the body to be charged to a predetermined electric potential, a cleaning member to clean foreign materials remaining on the surface of the body to be charged, and a cleaning member supporting bracket disposed in the housing to support the cleaning member and the charging member.

21 Claims, 7 Drawing Sheets

CHARGING MEMBER ASSEMBLY USABLE WITH BODY TO BE CHARGED AND CHARGING APPARATUS FOR IMAGE FORMING APPARATUS

CROSS-REFERENCE TO RELATED APPLICATIONS

This application claims the benefit under 35 U.S.C. §119 (a) from Korean Patent Application No. 2008-106668 filed Oct. 29, 2008 in the Korean Intellectual Property Office, the disclosure of which is incorporated herein by reference in its entirety.

TECHNICAL FIELD

The present disclosure relates generally to a developing apparatus for an image forming apparatus, and more particularly, to a developing apparatus allowing efficient supply of developer and/or an improved charging member support.

BACKGROUND OF RELATED ART

An image forming apparatus is an apparatus forming images on a printing medium, and may include, for example, a printer, a copy machine, a facsimile machine and a multi-functional product configured to perform some or all functions of aforementioned.

An electro photographic image forming apparatus is a type of image forming apparatus that uses a charging member to charge a surface of a photosensitive medium to a predetermined electric potential, and that scans light to the charged photosensitive medium to form electrostatic latent images on the surface of the photosensitive medium. A developing apparatus is used to apply developer to the electrostatic latent images on the photosensitive medium to develop the electrostatic latent images into visible images. The visible images may be transferred from the photosensitive medium surface directly onto a printing medium. Alternatively, the visible images may be transferred onto the printing medium through an intermediate transfer member, typically, for example, a belt. The images transferred on the printing medium are fixed on the printing medium through a fusing process.

A developing apparatus includes a developer storing chamber for storing developer, a developer supplying member and a developing member. The developer supplying member supplies the developing member with the developer stored in the developer-storing chamber. The developing member attaches the developer to the surface of the photosensitive medium on which the electrostatic latent images are formed so as to form visible images.

As the supply of the developer to the photosensitive medium and the charging of the surface of the photosensitive medium may each be an independent or in combination important aspects of an image forming process, particularly with respect to the image quality, it is desirable to improve upon these aspects.

SUMMARY OF THE DISCLOSURE

According to an aspect of the present disclosure, a charging apparatus usable with an image forming apparatus may be provided to include a housing, a body to be charged, a charging member, a cleaning member and a cleaning member supporting bracket. The body to be charged may be rotatably supported in the housing. The charging member may be disposed adjacent the body to be charged, and may be configured to charge a surface of the body to be charged to an electrical potential. The cleaning member may be configured to clean the surface of the body to be charged. The cleaning member supporting bracket may be disposed in the housing, and may be configured to support the cleaning member. The charging member may also be supported by the cleaning member supporting bracket.

The charging apparatus may further comprise a pair of charging member supporting holders each configured to support respective one of the opposite ends of the charging member. The pair of charging member supporting holders may be moveably supported by the cleaning member supporting bracket.

The cleaning member supporting bracket may comprise a cleaning member supporting portion, a first bending portion and a second bending portion. The cleaning member supporting portion may be configured to support the cleaning member. The first bending portion may extend from, and non-parallel to, the cleaning member supporting portion. The second bending portion may extend from, and non-parallel to, the first bending portion. The second bending portion may extend above the cleaning member supporting portion. Each charging member supporting holder may be disposed at a respective one of two opposite end portions of the second bending portion.

The cleaning member supporting bracket may further comprise left and right bending portions each of which may extend from, and forming approximately a right angle with, the second bending portion.

A portion of the second bending portion of the charging member supporting bracket between the two opposite end portions supporting the pair of charging member supporting holders is removed.

An elastic member may be disposed between the first bending portion of the cleaning member supporting bracket and each charging member supporting holder.

Each charging member supporting holder may include a pocket that may include an open end to receive and support therein the charging member.

The pocket of the charging member supporting holder may include a plurality of thin plates arranged to be parallel and spaced apart from each other.

The pocket of the charging member supporting holder may comprise a bushing.

The charging apparatus may further comprise a charging member cleaning member that may be disposed adjacent the charging member, and which may be configured to remove contaminants from the charging member. Each charging member supporting holder may comprise a supporting groove formed on a side thereof for supporting the charging member cleaning member.

The cleaning member supporting bracket may be formed of a metallic material.

According to another aspect, a charging apparatus may be usable with an image forming apparatus, and may include a housing, a body to be charged, a charging member, a cleaning member and a supporting frame. The body to be charged may be movably supported in the housing. The charging member may be disposed adjacent the body to be charged, and may be configured to charge a surface of the body to be charged to an electrical potential. The charging member may have rigid portions at opposite ends thereof. The cleaning member may be configured to remove unwanted material from the surface of the body to be charged. The supporting frame may be formed of a rigid body, and may be disposed in the housing to support the rigid portions of the charging member.

The supporting frame may comprise a base portion, a first bending portion and a second bending portion. The base portion may be fixedly supported by the housing. The first bending portion may extend non-parallel from the base portion. The second bending portion may extend non-parallel from the first bending portion and above the base portion.

The charging apparatus may comprise left and right charging member supporting holders each configured to support a respective one of rigid portions of the charging member, and may be disposed respectively at left and right ends of the second bending portion.

The supporting frame may further comprise left and right bending portions extending at substantially at a right angle from the left and right ends of the second bending portion.

According to yet another aspect, a developing apparatus for an image forming apparatus may include a housing accommodating therein a body to be charged. The developing apparatus may comprise a charging member, a cleaning member, left and right charging member supporting holders and a cleaning member supporting bracket. The charging member may be disposed adjacent the body to be charged, and may be configured to charge a surface of the body to be charged. The cleaning member may be configured to clean the surface of the body to be charged. The left and right charging member supporting holders may be configured to support opposite ends of the charging member. The cleaning member supporting bracket may be disposed in the housing, and may support thereon the cleaning member, the left charging member supporting holder and the right charging member supporting holder.

The cleaning member supporting bracket may comprise a cleaning member supporting portion, a first bending portion and a second bending portion. The cleaning member supporting portion may be configured to support the cleaning member. The first bending portion may extend from, and non-parallel to, the cleaning member supporting portion. The second bending portion may extend from, and non-parallel to, the first bending portion. The second bending portion may extend above the cleaning member supporting portion. The left and right charging member supporting holders may be disposed respectively at left and right ends of the second bending portion.

The cleaning member supporting bracket may further comprise left and right bending portions extending at substantially at a right angle respectively from the left end and right ends of the second bending portion.

An elastic member may be disposed between the first bending portion of the cleaning member supporting bracket and each of the left and right charging member supporting holders.

Each of the left and right charging member supporting holders may include a pocket having an open end to receive and support therein the charging member.

The pocket of the charging member supporting holder may be formed of a plurality of thin plates arranged to be parallel to and spaced apart from each other.

The developing apparatus may further comprise a developing roller, a developer storage chamber and a developer conveying belt. The developing roller may be disposed in the housing adjacent the body to be charged, and may be configured to supply developer to the body to be charged. The developer storage chamber may be defined in the housing for accommodating therein a quantity of developer. The developer conveying belt may be disposed in the developer storage chamber, and may be configured rotate in an endless loop in a direction of moving developer stored in the developer storage chamber toward the developing roller.

The developing apparatus may further comprise a first rotational member and a second rotational member. The first rotational member may be disposed in the developer storage chamber. The second rotational member may be disposed at a location in the developer storage chamber further away from the developing roller than the first rotational member is away from the developing roller. The developer conveying belt may be rotatably supported by the first and second rotational members. The radial center of the first rotational member may be larger than that of the second rotational member.

The radial center of the first rotational member may be positioned at a higher level with respect to a direction of gravitational force than the second rotational member.

The developing apparatus may further comprise a divider defining a boundary between the developer storage chamber and a remainder portion of the housing outside the developer storage chamber. The divider may comprise an opening through which developer from the developer storage chamber moves into the remainder portion of the housing. The opening may comprise a plurality of slits arranged to extend parallel to each and along a direction parallel to a rotational axis of the developing roller.

BRIEF DESCRIPTION OF THE DRAWINGS

Various aspects and utilities of the present disclosure will become apparent and more readily appreciated from the following description of the embodiments, taken in conjunction with the accompanying drawings, of which.

DETAILED DESCRIPTION OF SEVERAL EMBODIMENTS

Figure 1:
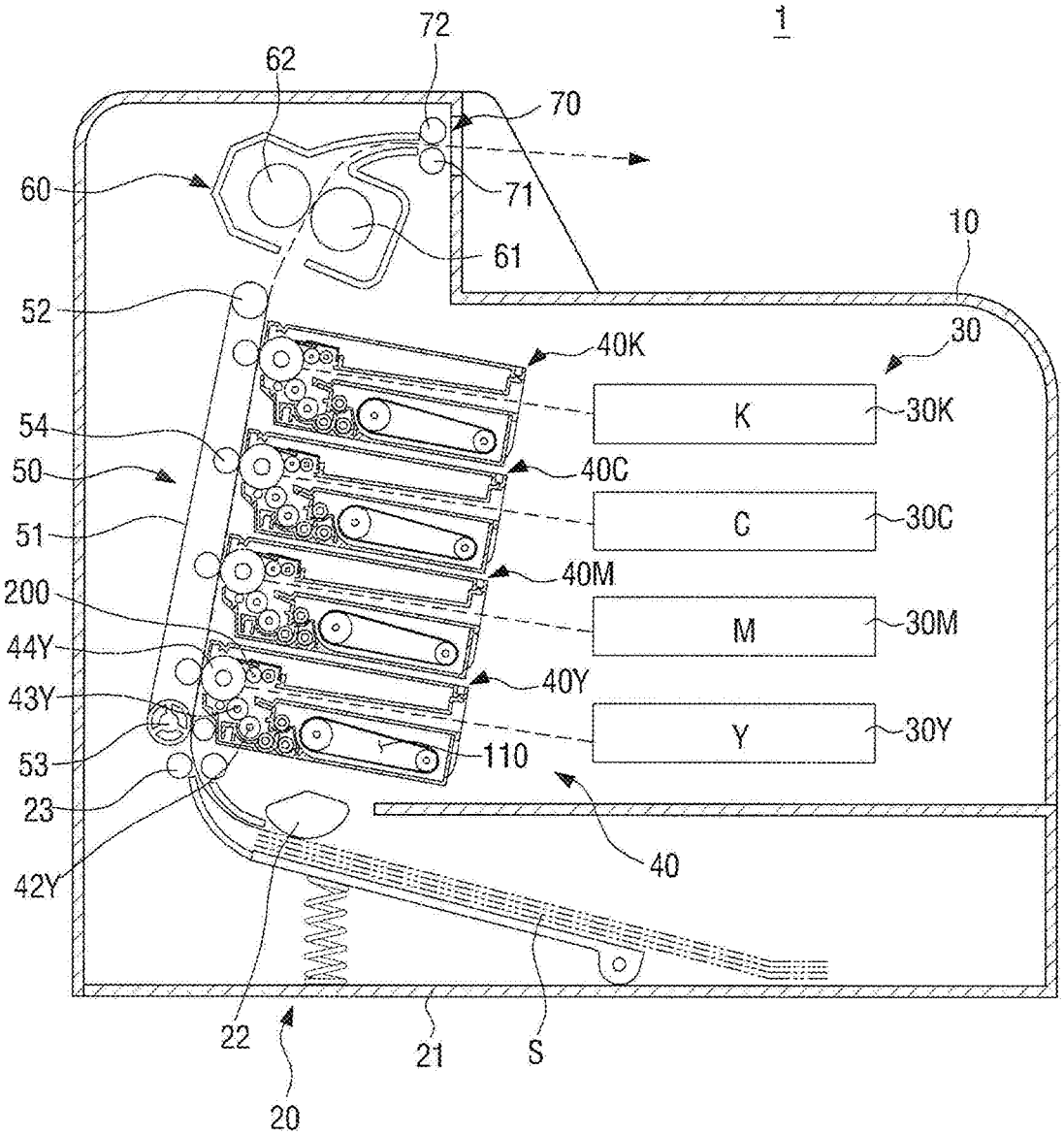
FIG. 1 is a sectional view schematically illustrating an image forming apparatus employing a charging apparatus according to an embodiment of the present disclosure.

Several embodiments of the present invention will now be described in greater detail with reference to the accompanying drawings. In the following description, same drawing reference numerals are used for the same elements even in different drawings.

The matters defined in the description, such as detailed construction and elements, are provided to assist in a comprehensive understanding of the embodiments. Thus, it should be apparent that the embodiments described herein can be carried out without those specifically defined matters. Also, well-known functions or constructions are not described in detail in order not to obscure the disclosure with unnecessary detail, and for the sake of brevity.

FIG. 1 is a sectional schematic view of an image forming apparatus 1 employing a developing apparatus and a charging apparatus according to an embodiment of the present disclosure.

Referring to FIG. 1, the image forming apparatus 1 may include a main body 10, a printing medium feeding unit 20, an exposure unit 30, a developing unit 40, a transfer unit 50, a fusing unit 60 and a printing medium discharging unit 70.

The main body 10 may define the external appearance of the image forming apparatus 1, and may support therein various parts, devices and/or components of the image forming apparatus 1.

The printing medium feeding unit 20 may include a cassette 21 storing sheets of printing media S, a pickup roller 22 picking up the printing media S stored in the cassette 21 one by one, and a conveying roller 23 conveying the picked up printing medium S to the transfer unit 50.

The exposure unit 30 may have, according to an embodiment, four exposing devices 30Y, 30M, 30C and 30K that each scan light corresponding to image information for one of yellow, magenta, cyan, and black colors to corresponding one of photosensitive media 44Y, 44M, 44C and 44K of the developing apparatuses 40Y, 40M, 40C and 40K, according to printing signals. The light from each of the four exposing devices 30Y, 30M, 30C and 30K forms an electrostatic latent image on the corresponding one of the photosensitive media 44Y, 44M, 44C and 44K.

The developing unit 40 may include, in this example, four developing apparatuses 40Y, 40M, 40C and 40K that receive different color developers, for example, yellow developer, magenta developer, cyan developer, and black developer, respectively. By way of example, the structure and function of the developing apparatus 40Y receiving yellow developer will be described, which description, unless specifically stated otherwise, is to be understood as applicable to the other three developing apparatuses 40M, 40C and 40K, which receives magenta developer, cyan developer, and black developer, respectively.

Figure 2:
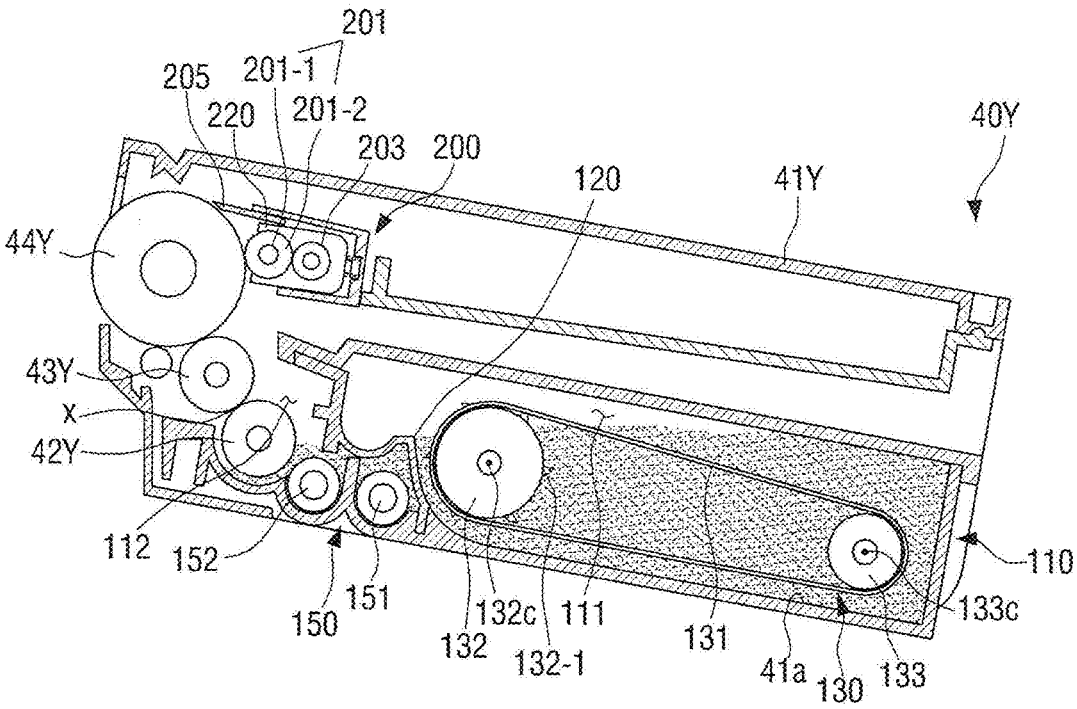
FIG. 2 is a sectional view illustrating a developing apparatus having a charging apparatus according to an embodiment of the present disclosure.

The developing apparatus 40Y may include a housing 41Y, a developer-storing chamber 110, a developer supplying member 42Y, a developing member 43Y, the photosensitive medium 44Y, and a charging member assembly 200 (see FIG. 2).

The developer-storing chamber 110 may be formed inside the housing 41Y (see FIG. 2), and may store developer that is going to be supplied to the photosensitive medium 44Y. The developer supplying member 42Y is disposed in the housing 41Y and supplies the developing member 43Y with the developer stored in the developer-storing chamber 110. The developing member 43Y attaches the developer to the surface of the photosensitive medium 44Y on which is formed an electrostatic latent image as a result of exposure to light received from the exposure unit 30Y, thereby forming a visible image thereon. The developer-storing chamber 110 may be provided with a developer conveying apparatus 130 (see FIG. 2) conveying the developer to the developer supplying member 42Y.

The photosensitive medium 44Y may be rotatably disposed at a leading end of the housing 41Y, and may receive the developer from the developing member 43Y. It should be noted that while in this example, the photosensitive medium 44Y is disposed integrally with the developing apparatus 40Y, the photosensitive medium 44Y may alternatively be disposed separately from the developing apparatus 40Y.

The charging member assembly 200 may charge a body to be charged at a predetermined electric potential, and may constitute a charging apparatus for an image forming apparatus. The charging member assembly 200 may charge the surface of the photosensitive medium 44Y, as an example of a body to be charged according to an embodiment, to a predetermined electric potential. According to some embodiments, the charging member assembly 200 may in addition remove foreign materials or contaminants, such as, for example, waste developer remaining on the surface of the photosensitive medium 44Y. The charging member assembly 200 will be explained in greater detail later.

The transfer unit 50 causes the visible images formed on the photosensitive medium 44Y to be transferred onto the printing medium, and may include a printing medium conveying belt 51, a plurality of transfer rollers 54 and conveying belt driving rollers 52 and 53.

The printing medium conveying belt 51 conveys the printing medium fed from the printing medium feeding unit 20 to the plurality of photosensitive media 44Y, 44M, 44C and 44K.

The conveying belt driving rollers 52 and 53 may be disposed at opposite ends, and inside, of the printing medium conveying belt 51 as illustrated in FIG. 1, and may drive the printing medium conveying belt 51 to rotate along an endless loop.

The plurality of transfer rollers 54 may oppose the respective associated one of the photosensitive media 44Y, 44M, 44C and 44K with the printing medium conveying belt 51 interposed therebetween, and may cause the visible images formed on the photosensitive media 44Y, 44M, 44C and 44K to be transferred onto the printing medium conveyed by the printing medium conveying belt 51.

The fusing unit 60 may include a heat roller 61 having a heat source and a pressure roller 62 disposed to face the heat roller 61. When the printing medium passes between the heat roller 61 and the pressure roller 62, the transferred images are fixed on the printing medium by the heat from the heat roller 61 and the pressure operating between the heat roller 61 and the pressure roller 62.

The printing medium discharging unit 70 may include a discharging roller 71 and a discharging backup roller 72, and may cause the printing medium passing through the fusing unit 60 to be discharged outside the main body 10.

FIG. 2 is a sectional view illustrating the developing apparatus 40Y according to an embodiment of the present disclosure usable, e.g., in the image forming apparatus 1 of FIG. 1.

As illustrated in FIG. 2, the developer-storing chamber 110 of the developing apparatus 40Y may be divided into a first developer-storing chamber 111 and a second developer-storing chamber 112 by a partition 120. The first and second developer-storing chambers 111 and 112 are in fluid communication with each other via an opening (not illustrated), which may be formed on a side of the partition 120.

According to an embodiment, the developing apparatus 40Y may also include a developer conveying apparatus 130 disposed in the first developer-storing chamber 111 and a middle conveying member 150 disposed near the partition 120 in the second developer-storing chamber 112.

As illustrated in FIG. 2, the developer conveying apparatus 130 may include a developer conveying belt 131, and a pair of driving shafts, that is, a first driving shaft 132 and a second driving shaft 133. The first driving shaft 132 may drive the developer conveying belt 131 to rotate. The second driving shaft 133 may rotatably support the developer conveying belt 131. In other words, the first driving shaft 132 may be a driving shaft to cause the developer conveying belt 131 to be rotated while the second driving shaft 133 may be a driven shaft rotated in turn by the developer conveying belt 131.

The developer conveying apparatus 130 may agitate developer stored in the first developer-storing chamber 111, and may convey some developer from the first developer-storing chamber 111 to the second developer-storing chamber 112. The developer conveying belt 131 may have a plurality of driving holes (not shown) for receiving a plurality of first driving protrusions 132-1 provided on the outer circumferential surface of the first driving shafts 132 of the developer conveying apparatus 130.

According to an alternative embodiment, the second driving shaft 133 may also be provided with a plurality of second driving protrusions formed on the outer circumferential surface thereof that may be received into the plurality of driving holes of the developer conveying belt 131. According to another alternative embodiment, one or both of the first and second driving shafts 132 and 133 may be formed in a shape capable of agitating developer stored in the developer-storing chamber 110. Such agitating shapes are known to those skilled in the art.

According to the embodiment illustrated in FIG. 2, the first driving shaft 132 may be located in a position near the second developer-storing chamber 112 while the second driving shaft 133 may be located in a position remote from the second developer-storing chamber 112. According to an embodiment, the surface diameter of the driving shaft 132 may be larger than the surface diameter of the second driving shaft 133. In addition, the first rotation center 132C of the first driving shaft 132 may be have a vertical position (i.e., in the gravitational direction) that is higher than the second rotation center 133C of the second driving shaft 133. That is, the first rotation center 132C may be located at a higher position than the second rotation center 133C in relation to the bottom 41*a* of the housing 41Y. According to an aspect of the present disclosure, the aforementioned arrangement may advantageously allow an effective control of the amount of developer conveyed by the developer conveying apparatus 130.

In a developing apparatus known heretofore, several agitators are typically arranged in the main developer storage chamber substantially horizontally to stir and/or convey the developer toward the developer supplying member. As an image forming apparatus typically has many developing apparatuses arranged vertically (see, e.g., the vertically stacked developing apparatus 40Y, 40M, 40C and 40K illustrated in FIG. 1), in order to reduce the overall height of the image forming apparatus, it may be necessary to reduce the height of each developing apparatus. Lowering the height of a developing apparatus unfortunately however also results in the reduction in the rotational radius of a agitator disposed inside the developing apparatus.

When the rotational radius decreases, the agitator is able to influence, and thus convey, a smaller volume of developer. The lowering of the height of a developing apparatus thus results in the reduction in the supply capacity of the agitator (s). As a result, when agitators are employed in a developing apparatus, the ability to reduce the height thereof may be limited and/or a large number of agitators may be necessary to ensure sufficient conveyance of the developer.

The provision of a large number of agitators is however not without consequences. The many agitators operating in the developing apparatus may subject the developer to an excessive level of stress, which may not be desirable. Also, in order to operate the agitators will likely add cost and complexity due to the complex driving mechanism that may be necessary.

According to an aspect of the present disclosure, by the use of the developer conveying belt 131, the developing apparatuses 40Y, 40M, 40C and 40K may have reduced heights, and may still accomplish supplying of the developer with a relatively simple driving mechanism, for example, a pair of rotatable driving shafts 132 and 133, but without requiring a large number of agitators and the complicated driving mechanisms and/or the excessive stress to the developer often attendant thereto.

According to an embodiment, in each of the developing apparatus 40Y, 40M, 40C and 40K, the size of the first developer-storing chamber 111 storing developer may be larger than that of the second developer-storing chamber 112 in proximity of which the image development process actually occurs. With such configuration, an excessive amount of developer being supplied from the first developer-storing chamber 111 to the second developer-storing chamber 112 may present various disadvantages due to the small space available in the second developer-storing chamber 112. The use of the developer conveying belt 131 according to an aspect of the present disclosure may advantageously enables an effective control in the amount of developer supplied to the second developer-storing chamber 112 when compared to the use of a number of agitators, and thus may be particularly advantageous when employed in a developing apparatus of the afore-mentioned developer storage chamber configuration.

According to an embodiment, for a more effective controlling of the supplying amount of developer, the developing apparatus 40Y, as an example, may be disposed in the main body 10 such that the first rotation center 132C of the first driving shaft 132 is located at a position of higher gravitational level, i.e., vertically higher, than the second rotation center 133C of the second driving shaft 133 as illustrated in FIGS. 1 and 2. In other words, the developing apparatus 40Y may be disposed in the main body 10 to be upwardly inclined toward the photosensitive medium 44Y. This arrangement may prevent the gravity from conveying developer from the first developer-storing chamber 111 to the second developer-storing chamber 112, and may allow only the developer conveying belt 131 to convey the developer, resulting in a more effective control of the amount of developer being supplied.

To certain degree, the first driving shaft 132 may perform functions that are different or additional to that the second driving shaft 133. For example, a function performed by the second driving shaft 133 may be to move developer from the rear portion of the first developer-storing chamber 111 towards the first driving shaft 132. To that end, the second driving shaft 133 may be given a small rotational radius. As the second rotation center 133C of the second driving shaft 133 is located at the lower and rear portion of the developing apparatus 40Y, a small rotational radius may be sufficient to enable the second driving shaft 133 to move the developer. The first driving shaft 132, on the other hand, not only facilitates the conveyance of the developer from the first developer-storing chamber 111 to the second developer-storing chamber 112, but may also withdraw excess developer from the second developer-storing chamber 112 back to the first developer-storing chamber 111. To that end, the first driving shaft 132 may be provided with a rotational radius larger than the second driving shaft 133 so that the first driving shaft 132 can move most of the developer that is supplied to, and withdrawn from, the second developer-storing chamber 112.

The opening (not illustrated) formed in the partition 120 dividing the first developer-storing chamber 111 and the second developer-storing chamber 112 may be of any suitable shape, for example, according to one or more embodiments, of a tetragonal or an oval shape, for example. Alternatively, according to other embodiments, at a position near the opening, there may be disposed an auger or another supplying member that can move the developer conveyed by the developer conveying apparatus 130 further toward the second developer-storing chamber 112. If a conveying member, e.g., an agitator that agitates the developer, is provided; according to one or more embodiments, the opening may be formed at a side of the partition 120 as, for example, a slit extending along the length of the partition 120. According to yet other alternative embodiments, a plurality of slits may be formed at predetermined intervals each extending along the length of the partition 120. When an auger type supplying member is provided, the opening may be formed at the end of the auger where the developer is delivered by such supplying member.

According to an embodiment, the developing apparatus 40Y or any other developing apparatus may have a shutter member (not illustrated) for closing the opening. The shutter member may be arranged such that the shutter member becomes open when a user pulls the shutter member from a side of the developing apparatus 40Y. Alternatively, the shutter member may be arranged so that during the mounting of the developing apparatus 40Y in the image forming apparatus 1 or when the developing apparatus 40Y is driven after being mounted in the image forming apparatus 1, the shutter member moves to a position to uncover the opening. The shutter member may be arranged to be open or close in cooperation with one or more rotation members disposed near the shutter member, for example, a supplying or circulating auger, or the like. The shutter member may be provided with or used in conjunction with an elastic member (not illustrated) providing an elastic bias for the shutter member to move in favor of either the open position or the closed position. A guide member (not illustrated) guiding movement of the shutter member may further be provided in the partition 120. A sealing member (not illustrated) may additionally be provided to prevent the developer from leaking around the shutter member. A shutter member is not a necessary in all embodiments herein, however, If one is provided, the size of the shutter member may be larger than that of the entering opening in order to realize the intended purpose thereof.

The middle conveying member 150 may include one or more conveying members in, for example, an auger or an agitator. For example, according to an embodiment, as illustrated in FIG. 2, two middle conveying members 151 and 152 may be provided in the second developer-storing chamber 112. The middle conveying members 151 and 152 may supply the developer that has been conveyed to the second developer-storing chamber 112 by the developer conveying apparatus 130 disposed in the first developer-storing chamber 111 toward the developer supplying member 42Y and the developing member 43Y.

According to an embodiment, either or both of the developer supplying member 42Y and the developing member 43Y may each be a roller type having a cylindrical shape. The roller type developer supplying member 42Y or the roller type developing member 43Y may have a conductive shaft at the center thereof and a roller body portion formed of, e.g., a conductive rubber material around the shaft. However, the shapes of the developer supplying member 42Y and the developing member 43Y need not be limited to the aforementioned. For example, the developer supplying member 42Y and the developing member 43Y may alternatively be a belt type or a brush type.

The developer supplying member 42Y and the developing member 43Y may be disposed to opposingly face each other so as to form a nip X at the contact therebetween. The developer supplying member 42Y and the developing member 43Y may rotate in the opposite direction with respect to each other when observed at the nip X. The developer becomes charged by the friction operating between the developer supplying member 42Y and the developing member 43Y as well moving to the developing member 42Y. According to an embodiment, in addition to frictionally charging, an electrical power, e.g., voltage, may be applied to each of the developer supplying member 42Y and the developing member 43Y to allow developer to move the developing member 43Y. If a direct current is applied, the absolute value of the electric power applied to the developing member 43Y should be smaller than that of the electric power applied to the developer supplying member 42Y so that a migration of the developer to the developing member 43Y may be realized by the electrical force.

Still referring to FIG. 2, the cleaning member 205 may scrape waste developer remaining on the photosensitive medium 44Y using a mechanical frictional force. According to an embodiment, the cleaning member 205 may be formed as a cleaning blade. The cleaning blade 205 may be supported by a cleaning member supporting bracket 210 (see FIGS. 6 and 7). The cleaning member supporting bracket 210 may be disposed in the housing 41Y of the developing apparatus 40Y. The cleaning blade 205 may be formed of a material having excellent abrasion resistance, such as, for example, rubber, urethane, silicone, or like material, and may be formed substantially in a plate shape having a thickness of, for example, about 1.5 mm to about 3 mm.

After the photosensitive medium 44Y is cleaned by the cleaning member 205, the photosensitive medium 44Y undergoes a charging process to allow the surface thereof to be charged to a predetermined electric potential. According to an embodiment, the charging member 201 may be a charging roller applying a high voltage of the same polarity as the developer to the photosensitive medium 44Y. The charging roller 201 may include a conductive metal shaft 201-1 and a outer roller portion 201-2 that is formed in a cylindrical shape on the outer circumferential surface of the shaft 201-1. The outer roller portion 201-2 may be made of a semiconductive rubber material, examples of which may include, NBR (Nitrile-budadiene rubber), EPDM (Ethylene-propylene-non-conjugated diene rubber), silicone, or various combinations thereof. When the outer roller portion 201-2 of the charging roller 201 is formed in a sponge shape, polyurethane may be used. Alternatively, polyurethane mixed with other materials may be used. In other embodiments, the outer roller portion 201-2 may be formed in two layers that one layer is a sponge layer and the other layer is a semiconductive material layer wrapped around on the sponge layer.

According to an embodiment, the charging roller 201 charges the photosensitive medium 44Y through a contact with the surface of the photosensitive medium 44Y, which is being described herein as but one example of a body chargeable with the charging roller 201. Alternatively, the charging roller 201 may be space apart from the photosensitive medium 44Y, in which case, the distance or the gap between the charging roller 201 and the photosensitive medium 44Y needs to be maintained substantially constant. To that end, one or more spacers for maintaining the gap may be disposed on either or both of the photosensitive medium 44Y and the charging roller 201. Alternatively, bearings may be disposed at opposite ends of a shaft 201-1 of the charging roller 201 or/and a shaft of the photosensitive medium 44Y so that a constant distance between the photosensitive medium 44Y and the charging roller 201 may be realized.

As the charging roller 201 is disposed near the photosensitive medium 44Y at a position that may subject the charging roller 201 to contaminants such as waste developer remaining on the surface of the photosensitive medium 44Y, the developing apparatus 40Y may also include a charging member cleaning member 203 for cleaning the surface of the charging roller 201.

According to an embodiment, the charging member cleaning member 203 is a roller type as is the charging roller 201, and may have an outer diameter substantially equal to or smaller than the outer diameter of the charging roller 201. The charging roller 201 and the charging member cleaning member 203 may be different from each other in the respective rotational speed at the point where the charging roller 201 contacts the charging member cleaning member 203 so that contaminants on the charging roller 201 can be removed by friction between the charging roller 201 and the charging member cleaning member 203. The charging member cleaning member 203 however need not be a roller type as illustrated in FIG. 2 and can take on various shapes and configurations, for example, it could be a film, plate type, a fur type, a brush type, or the like. The charging member cleaning member 203 may be provided to rotate or as a stationary member.

When the contacting nip or the gap between the charging roller 201 and the photosensitive medium 44Y is not uniformly maintained, the charging potential of the surface of the photosensitive medium 44Y may deviate. An electrical power applied to the charging roller 201 may be a direct current (DC), alternating current (AC) or a combination or mixture of DC and AC electrical power. When the electrical power is applied to the charging roller shaft 201-1, an electric discharge occurs from the surface of the charging roller 201. The electric discharge allows the surface of the photosensitive medium 44Y adjacent to the charging roller 201 to be charged to a predetermined electrical potential. For example, when the charging roller shaft 201-1 is supplied with a DC voltage of approximately, e.g., −1,400 volt, in the same polarity as the charged developer, the surface of the photosensitive medium 44Y may be charged to approximate −800 volt.

However, when the nip or the gap between the surface of the charging roller 201 and the surface of the photosensitive medium 44Y is allowed to vary, the surface of the photosensitive medium 44Y does not have the uniform charging voltage, e.g., of approximate −800 volt. When the charging condition is partially changed, for example, as a result of a change in the contacting nip or the gap between the surface of the charging roller 201 and the surface of the photosensitive medium 44Y, the surface charge of the photosensitive medium 44Y may be in a range of approximate −800±50 volt. The resulting developer image at the portion of the photosensitive medium 44Y having the surface electric potential of approximate −750 volt may have a developing density higher than the developer image formed on the portion of the photosensitive medium 44Y having the surface electric potential of approximate −800 volt. Also, the developer image formed on the portion of the photosensitive medium 44Y having the surface electric potential of approximate −850 volt may have a developing density lower than the developer image formed the portion of the photosensitive medium 44Y having the surface electric potential of approximate −800 volt. Accordingly, variations in the contact nip or the gap between the charging roller 201 and the surface of the photosensitive medium 44Y can result in a image density deviation.

It thus desirable to maintain the distance or gap between the charging roller 201 and the photosensitive medium 44Y, the distance of which may be affected by the distance between the shaft 201-1 of the charging roller 201 and the shaft of the photosensitive medium 44Y. The photosensitive medium 44Y may have a cylindrical shape formed substantially as a metal pipe with a shaft disposed at the center thereof. The photosensitive medium 44Y receives various pressure for the contacting relationships it has with certain of other surrounding components involved the developing process or the transfer process so that the center position of the photosensitive medium 44Y shaft stays substantially stationary. In particular, if bearings are disposed at opposite ends of the photosensitive medium shaft, the center position of the shaft of the photosensitive medium 44Y may be sufficiently restrained.

However, with respect to the charging roller 201 on the other hand, because of the limited space in which to place the charging roller, it may be difficult to provide bearings for supporting the shaft 201-1 of the charging roller 201. The provision of the bearings for supporting the shaft 201-1 may result in the increase in the size of the developing apparatus 40Y. Maintaining the position of the shaft 201-1 of the charging roller 201 is relatively stationary is nevertheless desirable in order for realizing a uniform image quality.

Figure 3:
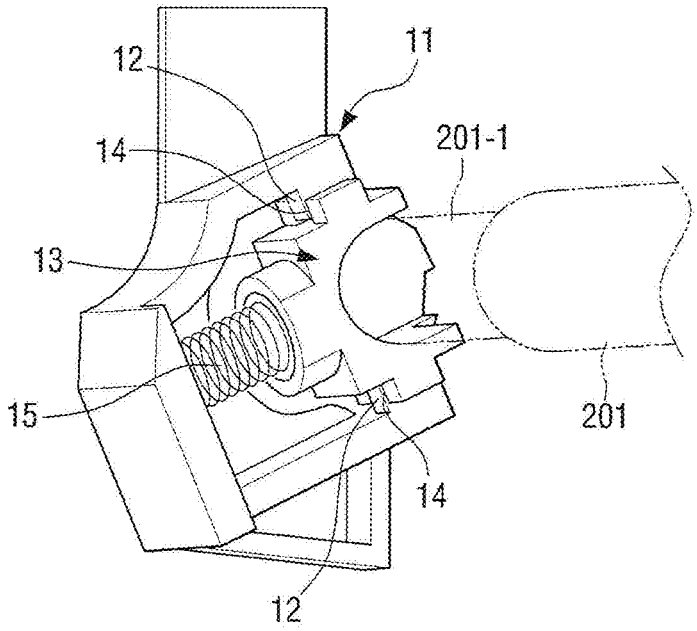
FIG. 3 is a perspective view of an illustrative example of a charging member supporting holder.

To this end, as illustrated in FIG. 3, an illustrative example of charge roller supporting structure may include a supporting base 11 and a charging roller supporting holder 13 supported on the supporting base 11, for supporting the charging roller shaft 201-1. The supporting base 11 may be fixedly supported by the housing 41Y of the developing apparatus 40Y.

Guide protrusions 12 of the supporting base 11 may be received in guide grooves 14 formed at the opposite ends of the charging roller supporting holder 13 so that the charging roller supporting holder 13 can slide with respect to the supporting base 11. Also, an elastic member, e.g., a spring 15, may be disposed between the supporting base 11 and the charging roller supporting holder 13. The spring 15 elastically supports the charging roller supporting holder 13 so that the contacting pressure between the photosensitive medium 44Y and the charging roller 201 may be maintained.

When the supporting base 11 is formed of molded plastic, which material may deform when as a result of external impact or force, while some of movement of the rotational axis of the charging roller shaft 201-1 resulting from the charging roller 201 contacting the photosensitive medium 44Y may be absorbed by the spring 15, the spring 15 however may not completely absorb impact or/and movement applied to the charging roller 201, still resulting in some impact reaching the supporting base 11 to result in a deformation of the shape of the supporting base 11. The change in the shape of the supporting base 11 may in turn result in the deviation of the position of the charging roller 201 supported by the supporting base 11. As a result, the contacting pressure or the gap between the charging roller 201 and the photosensitive medium 44Y may slightly change so that the electrical potential of the surface of the photosensitive medium 44Y may also change slightly. The deviation in the electrical potential may in turn result in the deviation of the image density as previously discussed.

It is thus preferable that the charging member 201 is supported by a metallic structure formed of a metallic material exhibiting a sufficient rigidity characteristic. According to an aspect of the present disclosure, a metallic support structure for the charging member may be formed integrally with the cleaning member supporting bracket, e.g., the bracket 210 holding the cleaning member 205. In such configuration, the deformation of the metallic structure may be minimized so as to realize stability in the charging process.

Figure 4:
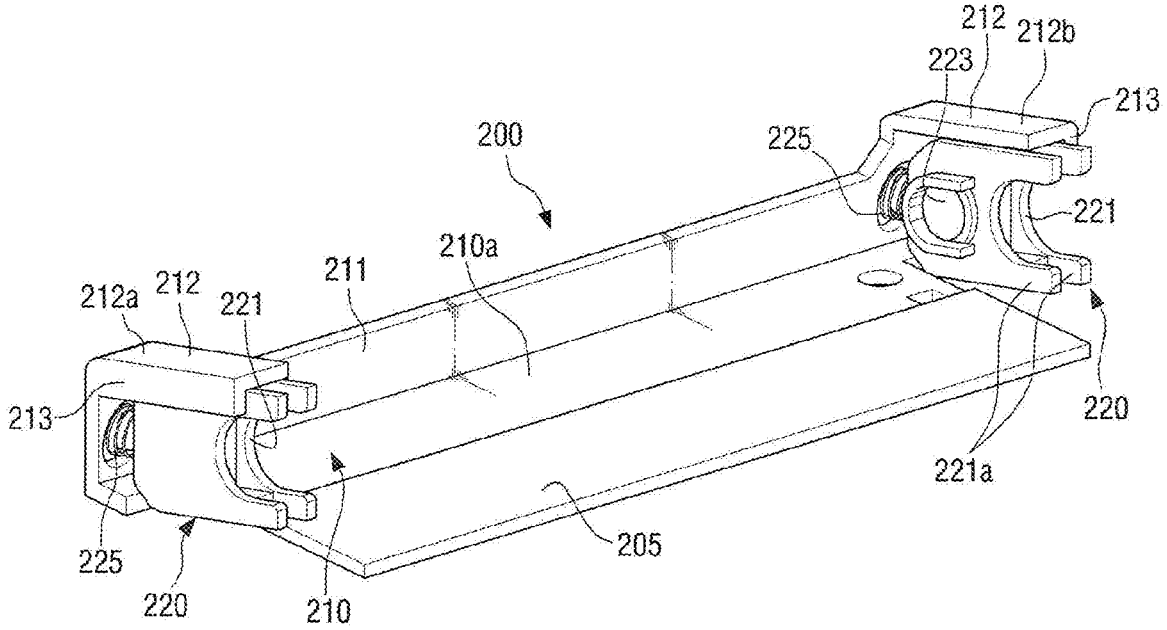
FIG. 4 is a perspective view illustrating a charging member assembly according to an embodiment of the present disclosure.
Figure 5:
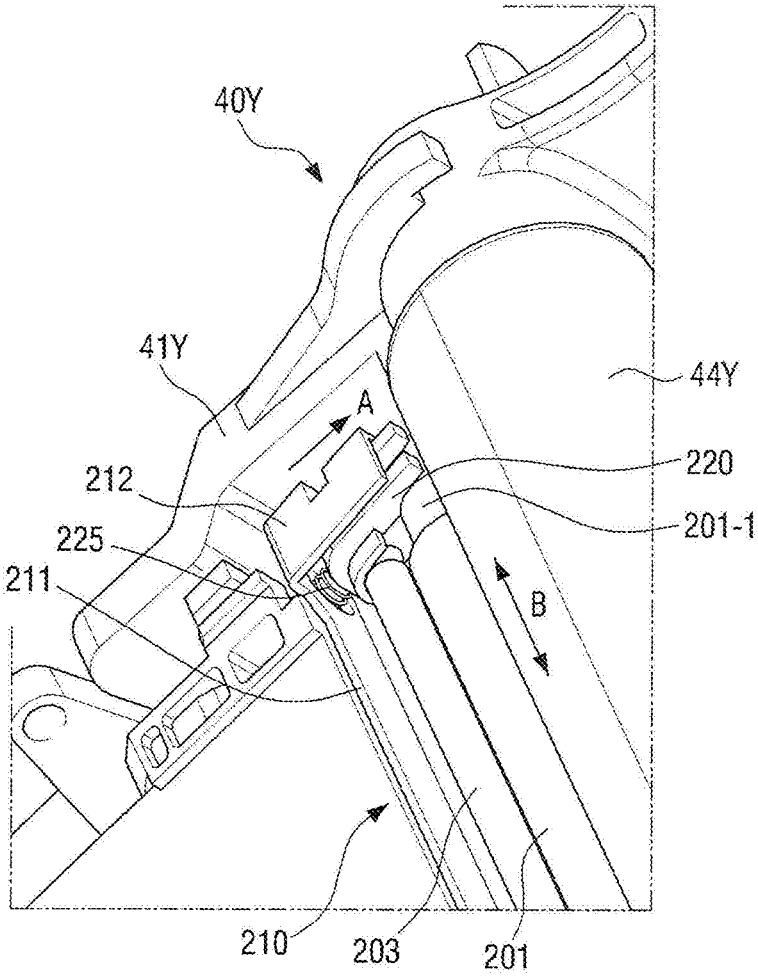
FIG. 5 is a partial perspective view illustrating the charging member assembly of FIG. 4 disposed in a developing apparatus.

FIG. 4 is a perspective view illustrating a charging member assembly 200 according to an embodiment of the present disclosure. FIG. 5 is a partial perspective view illustrating the charging member assembly 200 of FIG. 4 disposed in a developing apparatus, e.g., the developing apparatus 40Y.

Referring to FIG. 4, the cleaning member 205, for example, in the form of a cleaning blade, is disposed in the metal cleaning member supporting bracket 210. The cleaning member supporting bracket 210 may have a cleaning member supporting portion 210*a* in which the cleaning blade 205 is disposed, a first bending portion 211 for reinforcing the rigidity and a second bending portion 212 for reinforcing the rigidity and supporting the charging roller 201. The first bending portion 211, as illustrated in FIG. 4, may extend from the cleaning member supporting portion 210*a*, and may be spaced apart from the portion at which the cleaning blade 205. The first bending portion 211 may be bent from the cleaning member supporting portion 210*a* at an angle, for example, by approximate 90 degrees. The bending angle of the first bending portion 211 may adaptively varied depending on the rigidity of the cleaning member supporting bracket 210 required for a given implementation or application.

The second bending portion 212, as illustrated in FIG. 4, may extend from the first bending portion 211 in the direction opposing, and above, the cleaning member supporting portion 210*a*. The second bending portion 212 supports the charging member supporting holder 220, and guides the charging member supporting holder 220 to move toward the photosensitive medium 44Y. The second bending portion 212 guides the charging member supporting holder 220 to move in a direction perpendicular to the rotation center axis of the photosensitive medium 44Y, i.e., the direction indicated by the arrow A shown in FIG. 5. The second bending portion 212, as illustrated in FIG. 4, may be formed by removing the mid-section between the left end portion 212*a* and right end portion 212*b* so that the two end portions remain for supporting the charging member supporting holders 220. With the mid-section portion of the second bending portion 212 so removed, a reduction of the weight of the cleaning member supporting bracket 210 may be possible, and an easier access for the installation of the charging member 201 may be obtained.

Also as illustrated, a third bending portion 213 may be formed to extend from the second bending portion 212 of the cleaning member supporting bracket 210. The third bending portion 213, as illustrated in FIG. 4, may include a left bending portion and a right bending portion that extend respectively from the left end and the right end of the second bending portion 212, and may be bent at right angle toward the cleaning blade 205. The third bending portion 213 may prevent the left and right charging member supporting holders 220 from moving in a lengthwise direction (indicated by the arrow B in FIG. 5) of the charging roller 201.

According to an embodiment, the charging member supporting holder 220 may be formed of molded plastic. The mounting position and the movement of the charging member supporting holder 220 may be restricted by the second and third bending portions 212 and 213 of cleaning member supporting bracket 210. The charging member supporting holder 210 may be formed to support other elements in addition to the charging roller 201. According to an embodiment, the charging member supporting holder 210 may include a supporting groove 223 for supporting the charging member cleaning member 203 that cleans the charging member 201 as illustrated in FIGS. 2 and 5.

Figure 6:
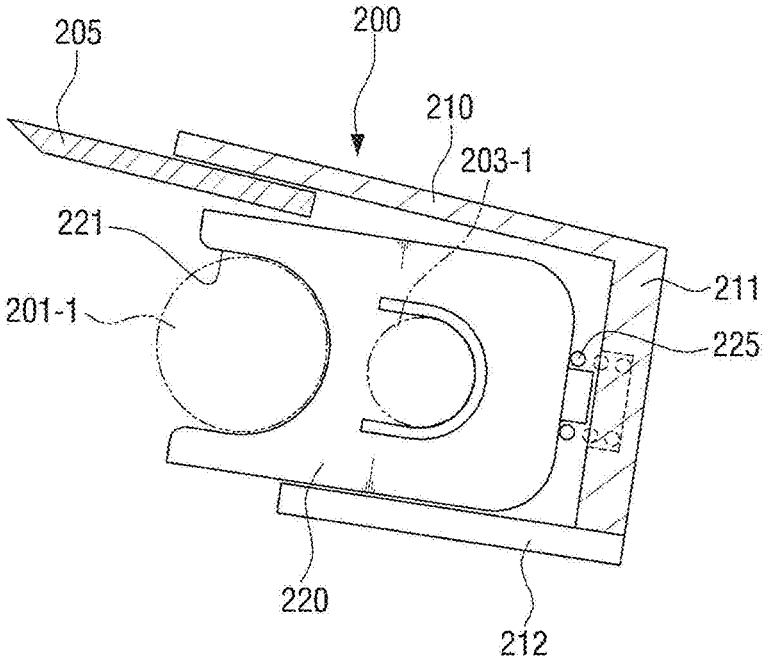
FIG. 6 is a sectional view illustrating the charging member assembly of FIG. 4 according to an embodiment of the present disclosure.

A pocket 221 supporting the shaft 201-1 of the charging roller 201 may be formed at an end of the charging member supporting holder 220. The pocket 221, as illustrated in FIG. 6, may have a curvature and a radius that correspond to the shaft 201-1 of the charging roller 201.

Alternatively, the pocket 221 of the charging member supporting holder 220 may be formed of a plurality of thin plates 221*a* as illustrated in FIGS. 4 and 5. When the pocket 221 contacts the shaft 201-1 of the charging roller 201, a large contacting area may cause the contacting portion of the pocket 221 of the charging member supporting holder 220 to wear out by function. It may be advantageous to minimize the contacting area of the pocket 221 on one hand. However, on the other hand, a large contacting area may have the advantage of providing a more stable support for the charging roller 201. To satisfy the above two conditions, according to an embodiment, the pocket 221 may be formed of a plurality of thin plates 221*a* having a groove corresponding to the outside diameter of the charging roller shaft 201-1. The plurality of thin plates 221*a* may be disposed parallel to, and space apart from, each other. According to an embodiment, the pocket 221 may be formed of two thin plates 221*a* as shown in FIG. 4. To further mitigate abrasion, a lubricant may be applied between the contacting portion of the pocket 221 and the shaft 201-1 of the charging roller 201.

Figure 7:
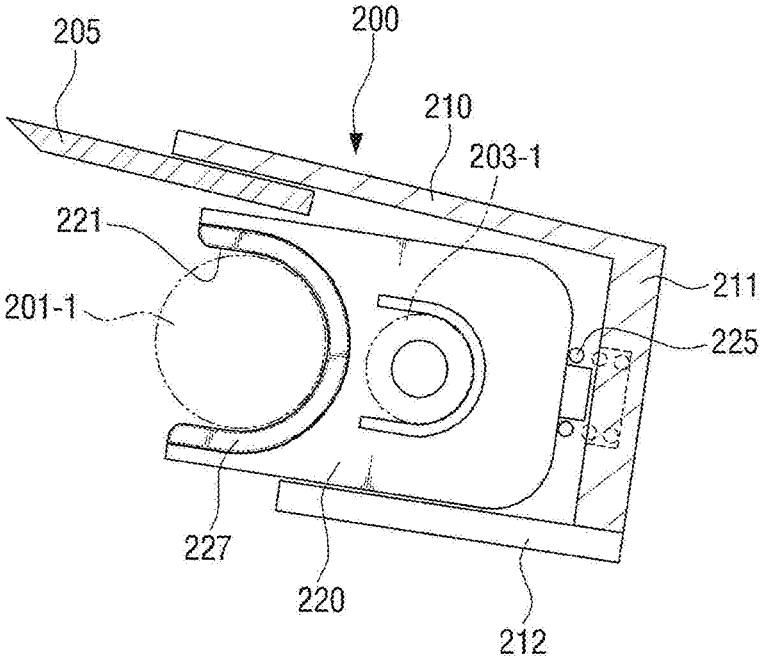
FIG. 7 is a sectional view illustrating a charging member assembly according to another embodiment of the present disclosure.

Alternatively, the pocket 221 of the charging member supporting holder 220 may not contact the shaft 201-1 of the charging roller 201 but instead, as illustrated in FIG. 7, a bushing 227 may be disposed between the pocket 221 and the charging roller shaft 201-1. The bushing 227 contacts and supports the shaft 201-1 of the charging roller 201. According to an embodiment, an elastic member, e.g., a spring, may be disposed between the bushing 227 and the charging member supporting holder 220. The bushing 227 may be formed from a thin plate similar to the pocket 221 as described above to reduce the frictional resistance caused by the contact and to maintain the sufficient supporting force.

An elastic member 225 may be disposed between the charging member supporting holder 220 and the cleaning member supporting bracket 210 so that the distance or gap between the charging roller 201 and the photosensitive medium 44Y may be maintained. A spring, for example, may be used as the elastic member 225.

The cleaning member supporting bracket 210, by which the charging roller 201, the charging member cleaning member 203 and the cleaning blade 205 are supported, may be disposed in the housing 41Y of the developing apparatus 40Y.

Figure 8:
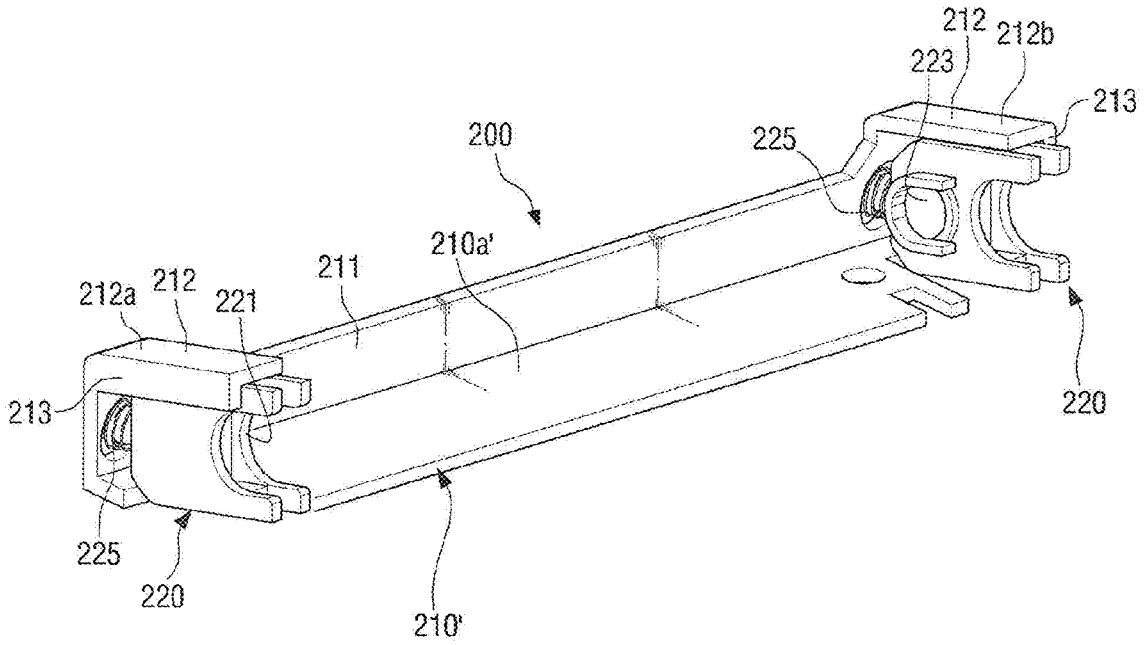
FIG. 8 is a perspective view illustrating a charging member assembly according to another embodiment of the present disclosure.

In the afore-described embodiments, the cleaning member supporting bracket 210 made of metallic material is employed to support the charging roller 201. However, the support structure for the charging roller need not be so limited. For example, as illustrated in FIG. 8, according to an alternative embodiment, a metal supporting frame 210' separate from the cleaning member supporting bracket 210 may be provided to support the charging roller 201. The supporting frame 210' may have configuration and features similar to the cleaning member supporting bracket 210, except of course it may not include the cleaning blade 205.

Referring to FIG. 8, the supporting frame 210' according to an embodiment of the present disclosure may have a base portion 210*a*' that may be fixed to the housing 41Y, a first bending portion 211 for reinforcing the rigidity, and a second bending portion 212 for additionally reinforcing the rigidity and for supporting the charging member 201. The first bending portion 211, as illustrated in FIG. 8, may extend from a side of the base portion 210*a*', and may be bent to form an angle, for example approximately 90 degrees, with the base portion 210*a*'. The second bending portion 212 may expend from the first bending portion 211, and may be bent by a predetermined angle to extend above the base portion 210*a*'. Left and right charging member supporting holders 220 may be disposed in the second bending portion 212 to support the opposite ends of the shaft 201-1 of the rotating charging roller 201. The left bending portion 213 and right bending portion 213 may be formed respectively at the left and right second bending portions 212, to form an angle, e.g., a right angle, with the second bending portions 212 to extend toward the base portion 210*a'*.

The supporting frame 210' may be made of a metallic material of sufficient rigidity so as to minimize deformation of the supporting frame 210' when subjected to the external forces and impacts. According to an embodiment, the shaft 201-1 of the charging roller 201 may also be made of a rigid material so that deformation of the shaft 201-1 due to external forces may also be minimized. A lubricant may be applied to the contacting portions between the charging member supporting holder 220 and the charging roller shaft 201-1 to reduce an abrasive contact between the charging member supporting holder 220 and the charging roller shaft 201-1. Structure and features of the left and right charging member supporting holders 220 may be substantially the same as previously described embodiments, the detailed descriptions of which will thus be not repeated.

According to an embodiment, the charging roller 201 formed as a rotatable roller of cylindrical shape may be used as the charging member. It should be readily understood by one skilled in the art however that the charging member 201 need not so limited. The charging member 201 may be various other types known to those skilled in the art. It is observed, not as a limitation however, that the various embodiments of charging member assembly herein described may have greater utility and advantage for a movable type, e.g., rotatable, charging member than for a stationary charging member.

Although several embodiments of the present disclosure have been shown and described, it would be appreciated by those skilled in the art that changes may be made in these embodiments without departing from the principles and spirit of the inventive aspects of the present disclosure, the scope of which is defined in the claims and their equivalents.

What is claimed is:

1. A charging apparatus usable with an image forming apparatus, comprising:
- a housing;
- a body to be charged rotatably supported in the housing;
- a charging member disposed on a charging roller shaft and adjacent the body to be charged, the charging member being configured to charge a surface of the body to be charged to an electrical potential;
- a cleaning member configured to clean the surface of the body to be charged;
- a cleaning member supporting bracket disposed in the housing and configured to support the cleaning member,
- wherein the charging member is supported by the cleaning member supporting bracket and a pair of charging member supporting holders, each comprising a plurality of contact plates each of which has a groove corresponding to an outside diameter of the charging roller shaft;
- a pair of elastic members, one in each charging member supporting holder, each disposed between the cleaning member supporting bracket and the charging member supporting holder; and
- a charging member cleaning roller disposed adjacent the charging member in a stationary charging member cleaning roller supporting bracket to remove contaminants from the charging member via rotational, non-translational movement,
- wherein the plurality of contact plates is arranged to be parallel and spaced apart from each other, and the groove formed in each of the plurality of contact plates is in contact with the charging roller shaft.

2. The charging apparatus of claim 1, further comprising:
- the pair of charging member supporting holders configured to support opposite ends of the charging member, the pair of charging member supporting holders being moveably supported by the cleaning member supporting bracket.

3. The charging apparatus of claim 2, wherein the cleaning member supporting bracket comprises:
- a cleaning member supporting portion configured to support the cleaning member;
- a first bending portion extending from, and non-parallel to, the cleaning member supporting portion and a second bending portion extending from, and non-parallel to, the first bending portion, the second bending portion extending above the cleaning member supporting portion,
- wherein each charging member supporting holder is disposed at a respective one of two opposite end portions of the second bending portion.

4. The charging apparatus of claim 3, wherein the cleaning member supporting bracket further comprises left and right bending portions each extending from, and forming approximately a right angle with, the second bending portion.

5. The charging apparatus of claim 3, wherein a portion of the second bending portion of the cleaning member supporting bracket between the two opposite end portions supporting the pair of charging member supporting holders is removed.

6. The charging apparatus of claim 3, wherein an elastic member is disposed between the first bending portion of the cleaning member supporting bracket and each charging member supporting holder.

7. The charging apparatus of claim 2, wherein the groove includes an open end to receive and support therein the charging member.

8. The charging apparatus of claim 7, wherein the plurality of contact plates is arranged to be parallel and spaced apart from each other.

9. The charging apparatus of claim 8, wherein the groove of the charging member supporting holder comprises a bushing.

10. The charging apparatus of claim 7,
- wherein each charging member supporting holder comprises a supporting groove formed on a side thereof for supporting the charging member cleaning roller.

11. The charging apparatus of claim 1, wherein the cleaning member supporting bracket is formed of a metallic material.

12. A charging apparatus usable with an image forming apparatus, comprising:
- a housing;
- a body to be charged movably supported in the housing;
- a charging member disposed on a charging roller shaft and adjacent the body to be charged, the charging member being configured to charge a surface of the body to be charged to an electrical potential, and the charging roller shaft having rigid portions at opposite ends thereof;
- a cleaning member configured to remove unwanted material from the surface of the body to be charged;
- a supporting frame formed of a rigid body, the supporting frame being disposed in the housing to support the rigid portions of the charging member;
- a pair of charging member supporting holders, each comprising a plurality of contact plates each of which has a groove corresponding to an outside diameter of the charging roller shaft; a pair of elastic members, one in each charging member supporting holder, each disposed between the supporting frame and the charging member supporting holder; and a charging member cleaning roller disposed adjacent the charging member in a stationary charging member cleaning roller supporting bracket remove contaminants from the charging member via rotational, non-translational movement, wherein the plurality of contact plates is arranged to be parallel and spaced apart from each other, and the groove formed in each of the plurality of contact plates is in contact with the charging roller shaft.

13. The charging apparatus of claim 12, wherein the supporting frame comprises:

a base portion fixedly supported by the housing;

a first bending portion extending non-parallel from the base portion; and a second bending portion extending non-parallel from the first bending portion and above the base portion.

14. The charging apparatus of claim 13, further comprising:

left and right charging member supporting holders each configured to support a respective one of rigid portions of the charging member, the left and right charging member supporting holders are disposed respectively at left and right ends of the second bending portion.

15. The charging apparatus of claim 13, wherein the supporting frame further comprises left and right bending portions extending at a substantially right angle from the left and right ends of the second bending portion.

16. A developing apparatus for an image forming apparatus including a housing accommodating therein a body to be charged, comprising:

a charging member disposed on a charging roller shaft and adjacent the body to be charged, the charging member being configured to charge a surface of the body to be charged;

a cleaning member configured to clean the surface of the body to be charged;

left and right charging member supporting holders each configured to support respective one of opposite ends of the charging member, each of the charging member supporting holders comprising a plurality of contact plates each of which has a groove corresponding to an outside diameter of the charging roller shaft;

a pair of elastic members, one in each charging member supporting holder, each disposed between a cleaning member supporting bracket and the charging member supporting holder;

the cleaning member supporting bracket disposed in the housing, the cleaning member supporting bracket supporting thereon the cleaning member, the left charging member supporting holder, and the right charging member supporting holder; and a charging member cleaning roller disposed adjacent the charging member in a stationary charging member cleaning roller supporting bracket remove contaminants from the charging member via rotational, non-translational movement, wherein the plurality of contact plates is arranged to be parallel and spaced apart from each other, and the groove formed in each of the plurality of contact plates is in contact with the charging roller shaft.

17. The developing apparatus of claim 16, wherein the cleaning member supporting bracket comprises:

a cleaning member supporting portion configured to support the cleaning member;

a first bending portion extending from, and non-parallel to, the cleaning member supporting portion; and a second bending portion extending from, and non-parallel to, the first bending portion, the second bending portion extending above the cleaning member supporting portion, wherein the left and right charging member supporting holders are disposed respectively at left and right ends of the second bending portion.

18. The developing apparatus of claim 17, wherein the cleaning member supporting bracket further comprises left and right bending portions extending at a substantially right angle respectively from the left end and right end of the second bending portion.

19. The developing apparatus of claim 17, wherein an elastic member is disposed between the first bending portion of the cleaning member supporting bracket and each of the left and right charging member supporting holders.

20. The developing apparatus of claim 16, wherein each of the left and right charging member supporting holders includes the groove having an open end to receive and support therein the charging roller shaft.

21. The developing apparatus of claim 20, wherein the plurality of contact plates is arranged to be parallel to and spaced apart from each other.

* * * * *